US007421784B2

(12) United States Patent
Akkala et al.

(10) Patent No.: US 7,421,784 B2
(45) Date of Patent: Sep. 9, 2008

(54) METHOD OF MANUFACTURING A WATER HEATER WITH A LEAK DETECTION SYSTEM

(75) Inventors: Marc W. Akkala, Cedarburg, WI (US); William R. Hoover, Grafton, WI (US)

(73) Assignee: AOS Holding Company, Wilmington, DE (US)

( * ) Notice: Subject to any disclaimer, the term of this patent is extended or adjusted under 35 U.S.C. 154(b) by 12 days.

(21) Appl. No.: 11/279,589

(22) Filed: Apr. 13, 2006

(65) Prior Publication Data

US 2007/0261241 A1 Nov. 15, 2007

(51) Int. Cl.
*B21D 53/02* (2006.01)
*F24H 1/00* (2006.01)

(52) U.S. Cl. ..... 29/890.03; 29/890.14; 122/13.01

(58) Field of Classification Search ..... 29/890.03, 29/890.031, 890.14; 122/13.01, 14.2, 14.22, 122/14.31

See application file for complete search history.

(56) References Cited

U.S. PATENT DOCUMENTS

| | | | | |
|---|---|---|---|---|
| 2,798,503 | A | 7/1957 | Carver et al. | |
| 3,473,553 | A | 10/1969 | Collins | |
| 3,920,031 | A | 11/1975 | Maxfield | |
| 4,805,662 | A * | 2/1989 | Moody | 137/312 |
| 5,029,605 | A | 7/1991 | Dowling et al. | |
| 5,315,291 | A | 5/1994 | Furr | |
| 5,334,973 | A * | 8/1994 | Furr | 340/605 |
| 5,345,224 | A * | 9/1994 | Brown | 340/605 |
| 5,355,841 | A | 10/1994 | Moore, Jr. et al. | |
| 5,844,492 | A | 12/1998 | Buffin, Sr. | |
| 5,857,482 | A | 1/1999 | Dowling | |
| 5,870,024 | A | 2/1999 | Arvelo, Jr. | |
| 5,877,689 | A | 3/1999 | D'Amico | |
| 5,881,762 | A | 3/1999 | Janesky | |
| 6,024,116 | A | 2/2000 | Almberg et al. | |
| 6,035,699 | A | 3/2000 | Parlante | |
| 6,084,520 | A | 7/2000 | Salvucci | |
| 6,109,216 | A * | 8/2000 | Reynolds et al. | 122/13.01 |
| 6,135,133 | A | 10/2000 | Ridgeway, Jr. | |
| 6,216,643 | B1 | 4/2001 | Reynolds et al. | |
| 6,253,785 | B1 | 7/2001 | Shumake, Jr. et al. | |
| 6,276,309 | B1 * | 8/2001 | Zeek | 122/504 |
| 6,295,951 | B1 | 10/2001 | Valcic et al. | |
| 6,295,952 | B1 | 10/2001 | Reynolds et al. | |
| 6,526,807 | B1 | 3/2003 | Doumit et al. | |
| 6,543,471 | B1 | 4/2003 | Carroll | |
| 6,895,990 | B1 | 5/2005 | Carroll | |

OTHER PUBLICATIONS

Page entitled "FirstSmart Sensor Corp., Manufacturer, Patent & Trademark holder for The Floodstopper System", http://www.thefloodstopper.com/prevent_water_damage.html, 6 pages, publicly available at least as early as Jul. 14, 2005.

(Continued)

*Primary Examiner*—David P. Bryant
*Assistant Examiner*—Sarang Afzali
(74) *Attorney, Agent, or Firm*—Michael Best & Friedrich LLP

(57) ABSTRACT

An original equipment manufacturer water heater including a water tank including an inlet and an outlet, means for heating water in the water tank, a base pan at least partially supporting the water tank such that water leaked from the water tank collects in the base pan, a valve closable to prevent water from entering the water tank through the inlet, and a sensor positioned in the base pan, the sensor configured to close the valve upon detecting water.

20 Claims, 2 Drawing Sheets

OTHER PUBLICATIONS

Page entitled "DynaQuip Controls—WaterCop Automatic Water Shut-off Systems", http://www.watercop.com, 4 pages, publicly available at least as early as Jul. 14, 2005.

Page entitled "Mobile Home Repair—Electronic Water Leak Detector", http://www.mobilehomerepair.com/waterdetect.htm, 2 pages, publicly available at least as early as Jul. 14, 2005.

Page entitled "Flood Control: FloodStop System II for Water Heater—AMFLOODSTOPII available fro . . . ", http://www.homecontrols.com/cgi-bin/main/co_disp/displ/carfnbr/0/prrfnbr/3175/FloodSto . . . , 2 pages, publicly available at least as early as Jul. 14, 2005.

Floodstop Stop Flood Damage Before It Really Starts! Brochure by Aqua Managers Inc.

Page entitled "Water Leak Detection Systems List of Manufacturers", http://www.statefarm.com/consumer/vhouse/articles/manufaclist.htm, 2 pages, publicly available at least as early as Jul. 14, 2005.

* cited by examiner

METHOD OF MANUFACTURING A WATER HEATER WITH A LEAK DETECTION SYSTEM

BACKGROUND

The present invention relates to water heaters.

SUMMARY

The invention provides an original equipment manufacturer water heater with a leak detection system.

In one embodiment, the invention provides a method of manufacturing and installing a water heater. The method includes manufacturing an original equipment manufacturer water heater including a water tank including an inlet and an outlet, means for heating water in the water tank, a base pan at least partially supporting the water tank such that water leaked from the water tank collects in the base pan, and a sensor positioned in the base pan, the sensor being configured to detect water. The method further includes installing the water heater by connecting a source of cold water to the water tank inlet, installing a valve closable to prevent water from entering the water tank inlet from the source of cold water, and connecting the sensor to the valve such that the valve closes when the sensor detects water.

In another embodiment the invention provides an original equipment manufacturer water heater including a water tank including an inlet and an outlet, means for heating water in the water tank, a base pan at least partially supporting the water tank such that water leaked from the water tank collects in the base pan, a valve closable to prevent water from entering the water tank through the inlet, and a sensor positioned in the base pan, the sensor configured to close the valve upon detecting water.

In another embodiment the invention provides a water heater including a base pan including a generally horizontal floor and an annular side wall extending upwardly from the floor, the side wall having an upper end and having therein an overflow port and an air intake opening, the base pan also including an annular step extending outwardly from the upper end of the side wall. The water heater further includes a water tank defined in part by a generally cylindrical tank wall, the water tank including an inlet and an outlet, a jacket substantially surrounding the water tank, foam insulation between the water tank and the jacket, a valve closable to prevent water from entering the water tank through the inlet, a combustion chamber beneath the water tank, the combustion chamber being defined in part by a substantially flat bottom with a centrally located air inlet surrounded by a raised annular portion, and the combustion chamber being defined in part by a generally cylindrical chamber wall having a lower end supported by the step of the base pan, a plurality of spacers between the step and the lower end of the chamber wall, the spacers transferring the weight of the combustion chamber and the water tank to the base pan and permitting water leaked into the space between the jacket and the water tank to flow into the base pan, a gas burner in the combustion chamber, a flame arrestor positioned in the raised annular portion and covering the air inlet such that flames cannot exit the combustion chamber via the air inlet, an exhaust flue extending upwardly from the combustion chamber and through the water tank, the base pan and the bottom of the combustion chamber forming an air plenum such that air flows into the combustion chamber via the air intake opening, the air plenum and the flame arrestor, a first sump positioned in the combustion chamber and at least partially defined by the flat bottom and by the raised annular portion, the first sump collecting condensate formed in the flue. The water heater further includes an annular sump in the floor of the base pan such that water leaked from the water tank collects in the annular sump until the level of the water reaches the overflow port, and an electronic sensor positioned in the annular sump, the sensor configured to close the valve upon detecting water or upon detecting a low battery condition. The water heater further includes a device that emits a visual and/or an audible signal upon detection of water or upon detection of a low battery, and an override device that allows the valve to be open when the sensor detects water, thus allowing normal operation of the water heater even while the water tank is leaking.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The preferred embodiment of the present invention is an original equipment manufacturer (OEM) flammable vapor ignition resistant (FVIR) water heater of the kind disclosed in U.S. Pat. Nos. 6,109,216; 6,216,643; 6,230,665; and 6,295,952, the entire contents of those patents being incorporated herein by reference. The concept of an integral leak detection system may also be applied to non-FVIR water heaters, as well as to electric water heaters. The present invention should therefore not necessarily be limited to FVIR water heaters.

Figure 3:
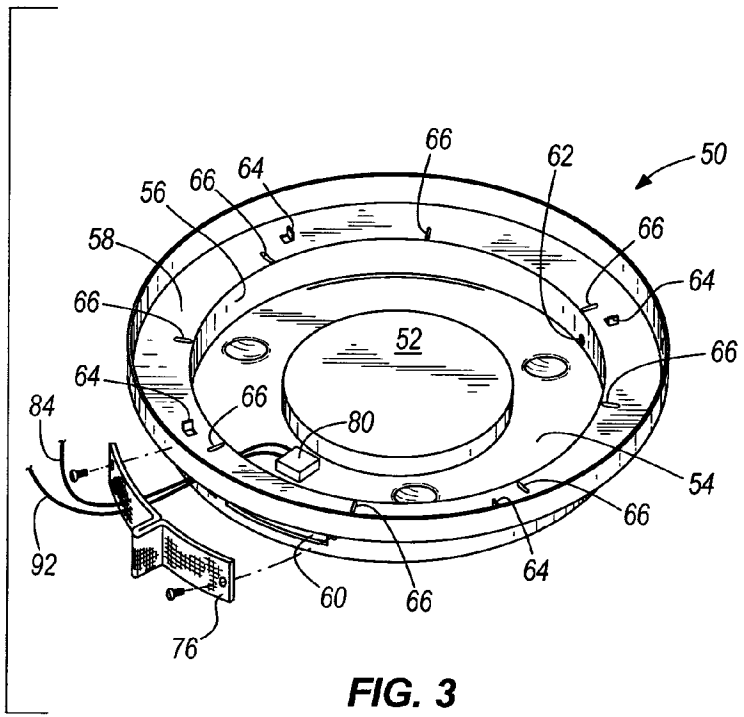
FIG. 3 is an exploded perspective view of a base pan of the water heater of FIG. 1.
Figure 1:
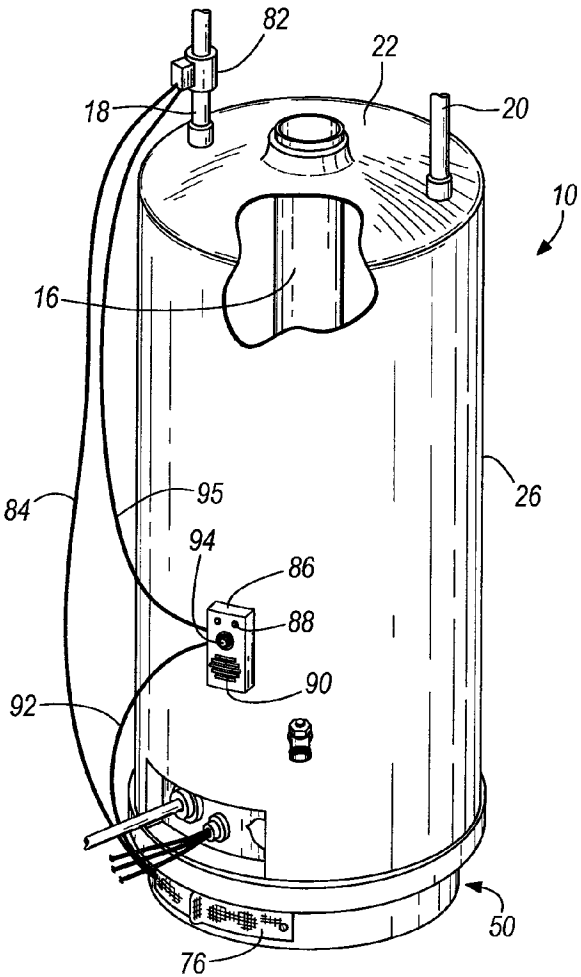
FIG. 1 is a perspective view of a water heater embodying the present invention.
Figure 2:
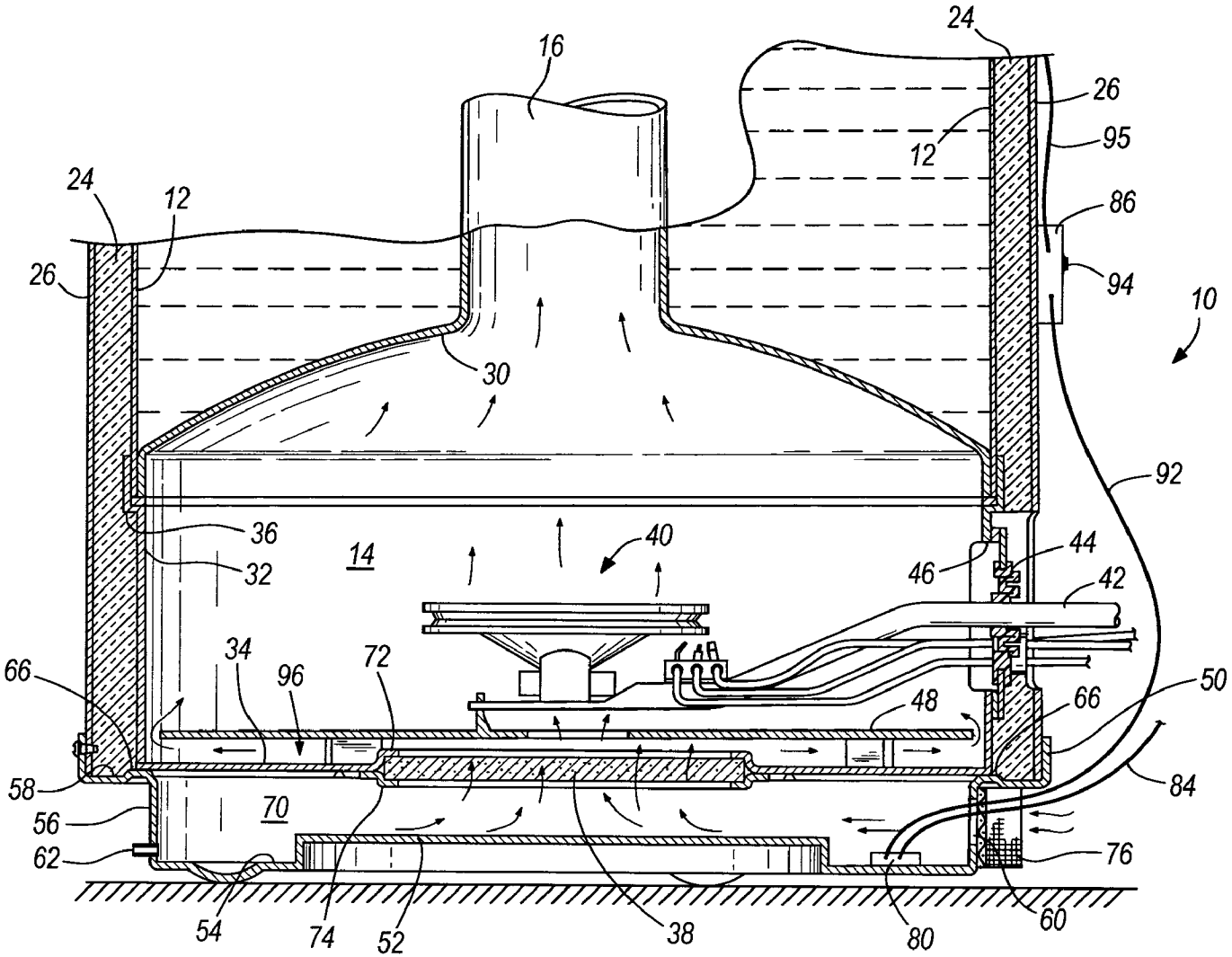
FIG. 2 is a cross section view of the bottom portion of the water heater of FIG. 1.

FIGS. 1-3 illustrate a storage-type gas-fired FVIR water heater 10. The water heater 10 includes a water tank 12, a combustion chamber 14, and a flue 16. The water tank 12 is substantially cylindrical, and is positioned above the combustion chamber 14. A cold water inlet 18 and a hot water outlet 20 extend through the top surface 22 of the water tank 12. The cold water inlet 18 is connected to a source of cold water. The water tank 12 is substantially surrounded by insulation material 24 to reduce heat loss through the water tank 12, and a thin jacket 26 surrounds and protects the insulation material 24. The flue 16 provides a flow path for products of combustion to flow from the combustion chamber 14, through the water tank 12, and through the top surface 22 of the water tank 12. The water in the tank 12 is heated by the flue 16.

The combustion chamber 14 is defined by the bottom surface 30 of the water tank 12, by a substantially cylindrical skirt 32, and by a divider 34. The bottom surface 30 of the tank is generally dome-shaped, and provides a flow path from the combustion chamber 14 into the flue 16. The skirt 32 surrounds the combustion chamber 14, and includes a shelf 36 supporting the water tank 12. The divider 34 defines the bottom of the combustion chamber 14, and supports a flame arrestor 38. The divider 34 defines an aperture surrounded by a raised annular portion 72. The flame arrestor 38 is supported within the raised annular portion 72 below the aperture, and forms a sealing relationship with the divider 34 around the circumference of the aperture. A support ring 74 is fastened to the underside of the divider 34, and supports the flame arrestor 38 within the raised annular portion 72 of the divider 34. A gas burner 40 is positioned in the combustion chamber above the divider 34. The gas burner 40 burns a mixture of fuel and combustion air to create hot products of combustion that flow through flue 16. The burner 40 receives gas fuel through a gas manifold tube 42 that extends in a sealed condition through an access door 44 mounted in a sealed condition over an access opening 46 in the skirt 32. The combustion chamber 14 further includes a radiation shield 48 positioned on the divider 34, below the burner 40, to reflect radiant heat toward the bottom surface 30 of the water tank 12.

The above-mentioned elements are supported by a base pan 50. The base pan 50 can be constructed of stamped metal, molded plastic, or any other suitable material. The base pan 50 includes a generally horizontal bottom wall that includes a raised center portion 52. The raised center portion 52 defines an annular sump 54 within the base pan 50. The base pan 50 also includes an annular side wall 56 and an annular step 58. The side wall 56 extends upwardly from the bottom wall, and the step 58 extends outwardly from the upper end of the side wall 56. An air inlet opening 60 and an overflow port 62 are disposed in the side wall 56. Metal tabs 64 (see FIG. 3) are formed (e.g., punched and bent) integral with the step 58 or are otherwise provided and affixed on the step 58, and coaxially position the base pan 50 and the skirt 32. A plurality of spacers 66 are positioned between the base pan 50 and the skirt 32 such that the spacers 66 transfer the weight of the water tank 12 to the base pan 50. In the illustrated embodiment, the spacers 66 are raised dimples that are formed integral with the base pan step 58. In some embodiments, the spacers 66 could be separate pieces attached to either of the base pan 50 and the skirt 32. The spacers 66 permit minimal contact between the base pan 50 and both the skirt 32 and the divider 34 to minimize the heat transfer from the skirt 32 and the divider 34 to the base pan 50.

The base pan 50 and the divider 34 at least partially define an air plenum 70. Air flows into the plenum 70 through the inlet 60 and flows out of the plenum 70 through the flame arrestor 38 and into the combustion chamber 14. With reference to FIG. 3, the air inlet 60 is covered by a screen 76 mounted to the outer surface of the base pan 50 such that all air passing through the air inlet 60 flows through the screen 76. The screen 76 filters air flow into the plenum 70 and reduces the likelihood that the flame arrester 38 will become occluded by lint or other debris. The flame arrestor 38 inhibits flames from leaving the combustion chamber 14 and potentially igniting combustion air outside of the combustion chamber 14. It should be noted that the position and orientation of the flame arrestor 38 are not limited to those shown in the drawings, and that the flame arrestor 38 can be positioned in substantially any manner provided all air flowing into the combustion chamber 14 first flows through the flame arrestor 38.

In the event that water leaks from the tank 12 from a location other than the bottom wall 30, at least some of the water flows down between the outside of the tank 12 and the jacket 26, between the bottom of the tank 12 and the step 58, between the spacers 66, and into the base pan 50 where the water collects in the annular sump 54. An electronic sensor 80 is positioned within the sump 54 to detect water. In some embodiments, a mechanical sensor could be used, such as a float sensor. The sensor 80 is connected by a wire 84 to a valve 82 adjacent the cold water inlet 18. The valve 82 is operable to open and close the inlet 18. In some embodiments, the valve 82 can be a magnetic latching valve, a solenoid valve, or any other suitable valve. Upon detection of water in the sump 54, the sensor 80 sends a signal to the valve 82 to stop water from flowing into the water heater 10 (see FIG. 1). Closing the valve 82 ensures that the water heater 10 will leak no more than the quantity of water held in the tank 12 when the leak was detected. The overflow port 62 is positioned in the sidewall 56 of the base pan 50 at a location above the sensor 80 and below the air inlet 60. Water will fill the base pan 50 until reaching the overflow port 62. A hose can be connected to the overflow port 62 to route the collected water to a suitable location, such as a floor drain, to prevent water from leaking beyond the base pan 50. A vacuum is gradually created within the tank as the water leaks due to the valve 82 being closed. If the location of the leak is below the top of the remaining water when sufficient vacuum is formed to hold the water in the tank 12, the remaining water will be held in the tank 12 rather than leaking.

Additionally, the sensor 80 is connected by a wire 92 to a control panel 86. The control panel 86 includes lights 88 to emit a visual signal when a leak is detected and a speaker 90 to emit an audible signal when a leak is detected. The control panel 86 also turns off the source of fuel to the water heater 10 upon detection of a leak.

The sensor 80 is powered by AC power readily available in homes. An override device 94 is connected to the valve 82 with wire 95. The override device 94 is positioned on the control panel 86 and allows an operator to permit the water heater 10 to remain in normal operation, even if a leak has developed. This allows an operator to continue to use the water heater 10 with a minor leak while shopping for a replacement water heater.

In some embodiments, the sensor 80 is battery powered, and is capable of detecting when the battery is running out of stored energy. If the sensor 80 is battery powered, it preferably includes a feature to warn of a low-battery condition, such as illuminating one of the lights 88 on the control panel 86. The sensor 80 preferably also activates the valve 82 when battery power is low. This will ensure that the sensor 80 will not cease to function and leave the water heater 10 in operation without leak detection capability.

Condensation may sometimes form within the flue 16, and such condensation tends to drip down into the combustion chamber 14. To prevent false activation of the sensor 80, the divider 34 and the raised annular portion 72 on the divider 34 at least partially define (see FIG. 3) a combustion chamber sump 96 to collect the condensation formed on the walls of the flue 16. Trapping the condensation in the combustion chamber 14 helps prevent the sensor 80 from being activated by condensation dripping or running into the annular sump 54 in the base pan 50. The water collected in the sump 54 will evaporate as the combustion chamber 14 warms from operation of the burner 40.

What is claimed is:

1. A method of manufacturing and installing a water heater, the method comprising:

manufacturing an original equipment manufacturer water heater including:

a water tank including an inlet and an outlet;

means for heating water in the water tank;

a base pan at least partially supporting the water tank such that water leaked from the water tank collects in the base pan; and a sensor positioned in the base pan, the sensor being configured to detect water, the sensor being battery-powered; and installing the water heater by:

connecting a source of cold water to the water tank inlet;

installing a valve closable to prevent water from entering the water tank inlet from the source of cold water; and connecting the sensor to the valve such that the valve closes when the sensor detects water and such that the valve closes in a low battery condition of the sensor.

2. The method of claim 1, wherein the means for heating water includes a combustion chamber, a flue extending from the combustion chamber through the water tank, and a gas burner positioned in the combustion chamber.

3. The method of claim 2, wherein manufacturing an original equipment manufacturer water heater further includes providing a flame arrestor such that combustion air flows through the flame arrestor before entering the combustion chamber.

4. The method of claim 1, wherein manufacturing an original equipment manufacturer water heater further includes providing a jacket surrounding the water tank such that water leaked from the water tank flows between the water tank and the jacket and into the base pan.

5. The method of claim 4, wherein manufacturing an original equipment manufacturer water heater further includes providing spacers between the water tank and the base pan to facilitate flow of leaked water into the base pan.

6. The method of claim 1, wherein manufacturing an original equipment manufacturer water heater further includes providing an overflow port such that water collects in the base pan until reaching the overflow port, and installing the water heater includes routing the collected water from the overflow port to a suitable location.

7. The method of claim 1, wherein manufacturing an original equipment manufacturer water heater further includes providing an override device that allows the valve to be open when the sensor detects water.

8. The method of claim 1, wherein manufacturing an original equipment manufacturer water heater further includes providing a device that emits a visual and/or an audible signal upon detection of water or upon detection of the low battery condition.

9. The method of claim 1, wherein manufacturing an original equipment manufacturer water heater includes providing means for heating water including a combustion chamber and a flue, and a sump for collecting condensation from the flue, the sump inhibiting condensation from flowing into the base pan.

10. The method of claim 1, wherein manufacturing an original equipment manufacturer water heater includes providing means for heating water including a combustion chamber, and a base pan including a bottom wall and a side wall extending from the bottom wall, the side wall defining a water outlet port and an air inlet opening located above the outlet port, air flowing through the inlet opening and into the combustion chamber, leaked water flowing through the outlet port, and wherein the sensor is positioned in the base pan below the outlet port.

11. The method of claim 1, wherein manufacturing an original equipment manufacturer water heater further includes providing an override device that allows the valve to be open in a low battery condition of the sensor.

12. A method of manufacturing and installing a water heater, the method comprising:

manufacturing an original equipment manufacturer water heater including:

a water tank including an inlet and an outlet;

means including a combustion chamber for heating water in the water tank, the combustion chamber having a lower surface defining an aperture;

a base pan at least partially supporting the water tank such that water leaked from the water tank collects in the base pan, the base pan including a bottom wall and a side wall extending from the bottom wall, the side wall defining a water outlet port and an air inlet opening, the inlet opening being located above the outlet port and below the aperture, air flowing through the inlet opening, through the aperture and into the combustion chamber, leaked water flowing through the outlet port; and a sensor positioned in the base pan below the outlet port, the sensor being configured to detect water; and installing the water heater by:

connecting a source of cold water to the water tank inlet;

installing a valve closable to prevent water from entering the water tank inlet from the source of cold water; and connecting the sensor to the valve such that the valve closes when the sensor detects water.

13. The method of claim 12, wherein manufacturing an original equipment manufacturer water heater further includes providing a jacket surrounding the water tank such that water leaked from the water tank flows between the water tank and the jacket and into the base pan.

14. The method of claim 13, wherein manufacturing an original equipment manufacturer water heater further includes providing spacers between the water tank and the base pan to facilitate flow of leaked water into the base pan.

15. The method of claim 12, wherein manufacturing an original equipment manufacturer water heater further includes providing a screen covering the inlet opening.

16. The method of claim 12, wherein the means for heating water includes a flue extending from the combustion chamber though the water tank, and a gas burner positioned in the combustion chamber 17. The method of claim 12, wherein manufacturing an original equipment manufacturer water heater further includes providing a flame arrestor supported in the aperture such that combustion air flows through the inlet opening and through the flame arrestor before entering the combustion chamber.

18. The method of claim 12, wherein installing the water heater includes routing the collected water from the outlet port to a suitable location.

19. The method of claim 12, wherein manufacturing an original equipment manufacturer water beater further includes providing an override device that allows the valve to be open when the sensor detects water.

20. The method of claim 12, wherein the sensor is battery-powered, and wherein installing the water heater includes connecting the sensor to the valve such that the valve closes when the sensor detects water and such that the valve closes in a low battery condition of the sensor.

* * * * *